United States Patent [19]

Panten et al.

[11] Patent Number: 5,067,470

[45] Date of Patent: Nov. 26, 1991

[54] EXHAUST-GAS RECYCLING DEVICE FOR AN INTERNAL-COMBUSTION ENGINE

[75] Inventors: Detlef Panten, Korb; Dirk Naber, Stuttgart; Franz Bender, Wendlingen, all of Fed. Rep. of Germany

[73] Assignee: Mercedes-Benz AG, Fed. Rep. of Germany

[21] Appl. No.: 599,443

[22] Filed: Oct. 18, 1990

[30] Foreign Application Priority Data

Oct. 21, 1989 [DE] Fed. Rep. of Germany ..... 3935093

[51] Int. Cl.[5] ..... F02B 47/08; F02D 21/08; F02M 25/07

[52] U.S. Cl. ..... 123/568

[58] Field of Search ..... 123/568, 569, 571; 251/61, 61.4, 61.5; 137/907

[56] References Cited

U.S. PATENT DOCUMENTS

| | | | |
|---|---|---|---|
| 3,756,210 | 9/1973 | Kuehl | 123/568 |
| 4,044,739 | 8/1977 | Miura et al. | 123/568 |
| 4,180,034 | 12/1979 | Vogelsberg | 123/568 |
| 4,196,707 | 4/1980 | Stoltman | 123/568 X |
| 4,312,319 | 1/1982 | Brakebill | 123/568 |

FOREIGN PATENT DOCUMENTS

| | | | |
|---|---|---|---|
| 2365341 | 11/1974 | Fed. Rep. of Germany . | |
| 2549959 | 5/1980 | Fed. Rep. of Germany . | |
| 2528760 | 12/1980 | Fed. Rep. of Germany . | |
| 0123621 | 9/1979 | Japan | 123/568 |

*Primary Examiner*—Willis R. Wolfe

*Attorney, Agent, or Firm*—Evenson, Wands, Edwards, Lenahan & McKeown

[57] ABSTRACT

In an exhaust-gas recycling device for internal-combustion engines, especially diesel engines, in which the exhaust-gas recycling quantity is controlled as a function of the engine running via an exhaust-gas recycling valve mounted in the exhaust-gas recycling line, it is to be possible to regulate the exhaust-gas recycling flow quantity independently of flow resistances changing in the fresh-gas intake and exhaust-gas lines. For this purpose, changes of flow resistance in the fresh-gas intake and exhaust-gas lines are fed as additional pressure control signals to the exhaust-recycling valve. A change of flow resistance in the exhaust-gas line can occur particularly as a result of a soot burn-off filter which is installed there an on which the soot is burnt off at irregular time intervals.

2 Claims, 2 Drawing Sheets

EXHAUST-GAS RECYCLING DEVICE FOR AN INTERNAL-COMBUSTION ENGINE

BACKGROUND AND SUMMARY OF THE INVENTION

The invention relates to an exhaust-gas recycling device for an internal-combustion engine, with an exhaust-gas recycling line branched off from an exhaust-gas line to an inlet line and with an exhaust-gas recycling valve arranged in the exhaust-gas recycling line and comprising a valve controlling the connection between the inlet and outlet lines and a pneumatic control drive consisting of two diaphragms which are clamped in a housing and which are connected operatively to a closing part of the valve, at least one diaphragm being connected firmly to the closing part, and the two diaphragms each being loaded by a spring in the closing direction of the closing part, the diaphragms subdividing the housing into at least two control chambers, of which a first control chamber located between the diaphragms can be subjected to a control pressure determined as a function of the engine running and a second control chamber formed by the second diaphragm and the housing can be subjected to a further control pressure.

An exhaust-gas recycling device of this type is known, for example, from German Patent Specification 2,528,760. There, the exhaust-gas recycling valve is controlled simultaneously as a function of the throughput of combustion gas and of the engine load state. The load state is detected from the height of the vacuum within the fresh-gas intake line, and the gas throughput is detected from the height of the exhaust-gas counterpressure in the exhaust-gas line. The gradient between the two pressures determines the particular opening cross-section of the exhaust-gas recycling valve. The actuating drive for the closing part of the exhaust-gas recycling valve consists of diaphragms connected to this and exposed to the above-mentioned pressure gradient.

Such a control of the exhaust-gas recycling valve is incapable of eliminating disturbing influences arising from unintentional changes of flow resistance in the fresh-gas intake and/or exhaust-gas line. Such changes of flow resistance can occur, for example, because filters in the intake line and/or exhaust-gas line become clogged. An especially disturbing effect is caused, in that respect, by so-called soot burn-off filters in diesel engines when the soot is burnt off intermittently on these. For then, the throughflow resistance of the filter varies undesirably over a wide range during the running of the engine, with the result that the exhaust-gas recycling quantity dependent on the pressure gradient between the intake and exhaust-gas lines for a specific opening cross-section of the exhaust-gas recycling valve is falsified in relation to the value which it should actually have on the basis of the predetermined control of the exhaust-gas recycling valve as a function of the engine running.

An object of the invention is to provide an improvement in such an exhaust-gas recycling device.

This object is achieved according to the invention by providing an arrangement wherein the second control chamber is subjected as a control pressure to the exhaust-gas pressure from the exhaust-gas line.

An embodiment which is highly advantageous in terms of construction includes an arrangement wherein, interposed between the first and second control chambers is a third control chamber which is separated from the first control chamber by a rigid connecting wall and on which the compression spring of the second diaphragm is supported, wherein the second diaphragm is attached rigidly to the first diaphragm via a driving rod guided displaceably through the connecting wall, wherein a third diaphragm sealing off the lead-in of the driving rod through the connecting wall is arranged in the third control chamber, and wherein the third control chamber is subjected to a control pressure from the inlet line.

Other objects, advantages and novel features of the present invention will become apparent from the following detailed description of the invention when considered in conjunction with the accompanying drawings.

DETAILED DESCRIPTION OF THE DRAWINGS

Figure 1:
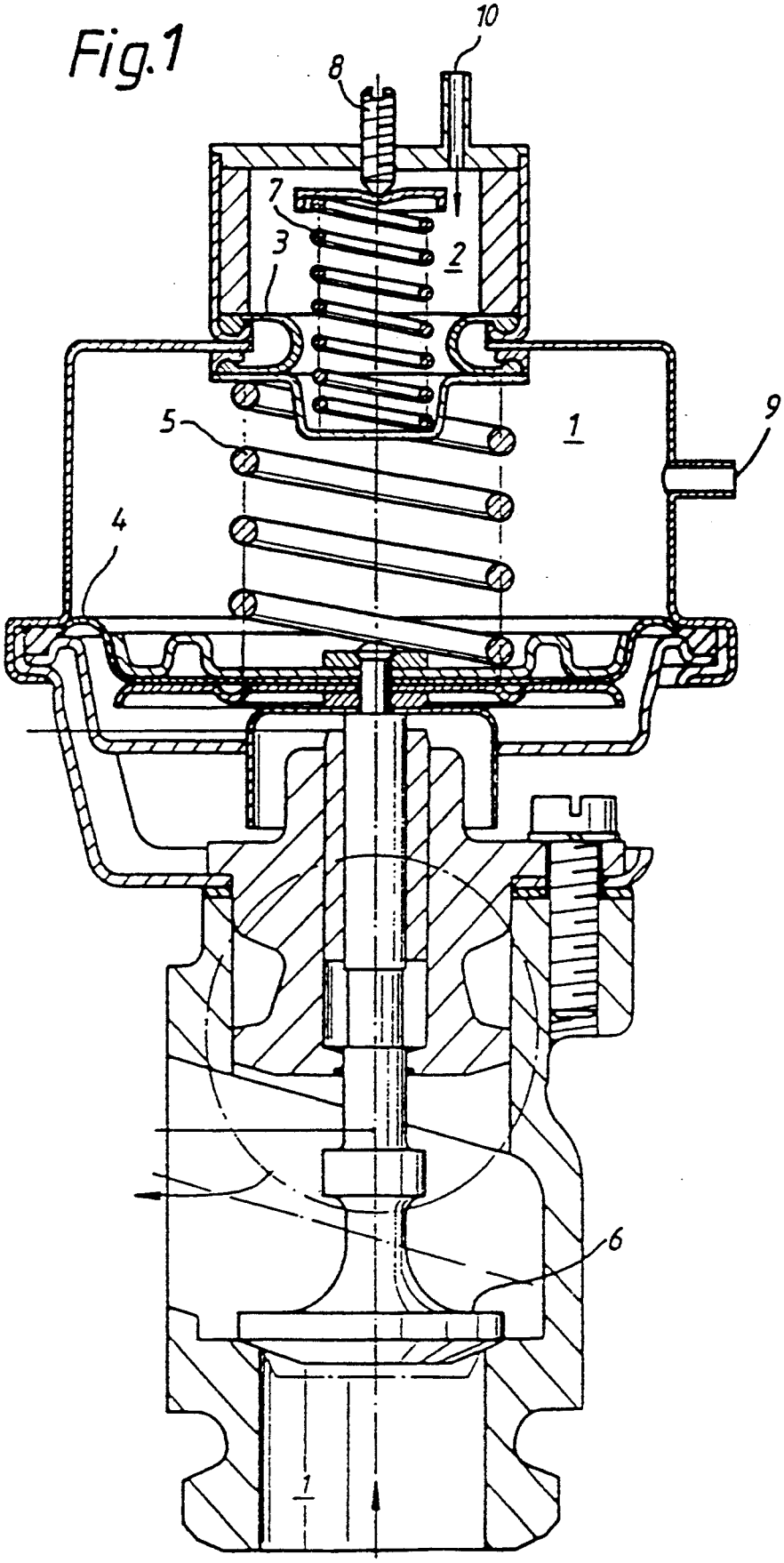
FIG. 1 is a schematic sectional view through an exhaust-gas recycling valve, in which only disturbing resistances of the exhaust-gas line can be eliminated, constructed according to a preferred embodiment of the invention.

The exhaust-gas recycling valve according to FIG. 1 possesses a pneumatic control drive consisting of a first control chamber I and of a second control chamber 2 which are connected operatively to one another via a first diaphragm 3. That wall of the first control chamber 1 located opposite the first diaphragm 3 is designed as a second diaphragm 4. The effective surface of the second diaphragm 4 is larger than that of the first diaphragm 3. A first compression spring 5 is supported between the two diaphragms 3, 4. The closing part 6 of the exhaust-gas recycling valve is connected firmly to the second diaphragm 4.

Inside the second control chamber 2, a second compression spring 7 is supported on the first diaphragm 3. The pressure force exerted on the diaphragm 3 by the compression spring 7 can be regulated via an adjusting screw 8.

A vacuum dependent on the running of the engine is applied to the control chamber 1 via a connection piece 9. The second control chamber 2 is exposed to the pressure in the exhaust-gas line via a further connection piece 10.

The control pressure dependent on the engine running and applied to the connection piece 9 of the first control chamber 1 is independent of the pressure in the exhaust-gas line. In particular, this control pressure is independent of changes of throughput in the intake and exhaust-gas lines and is predetermined according to a family of characteristics as a function of the load and speed of the engine in respect of impressed pressures obtained from specific geometrical variables.

With a constant flow resistance in the exhaust-gas line, an adjustability of the control pressure to be fed to the control chamber I makes it possible to obtain a particularly desired predeterminable exhaust-gas recycling quantity as a function of the engine running by means of an appropriate adjustment of the exhaust-gas recycling valve.

If only the first control chamber 1 were present, a variation in the flow resistance of the exhaust-gas line would falsify the exhaust-gas recycling quantity desired per se for the particular engine running state because of the resulting variation of the pressure gradient between the exhaust-gas line and fresh-gas line. However, such a falsification can be avoided by taking into account the pressure in the exhaust-gas line at the point from which the exhaust gas to be recycled is branched off, if the respective exhaust-gas pressure is fed to the abovedescribed second control chamber of the pneumatic actuating drive of the exhaust-gas recycling valve.

The cause of a flow resistance in the exhaust-gas line varying independently of the particular engine running state can, for example, be a soot burn-off filter which, in diesel engines can be installed in the exhaust-gas line for separating off soot particles.

If the exhaust-gas counterpressure upstream of the soot filter, from where the exhaust gas to be recycled is branched off, is varied as a result of soot deposits on the soot filter, with only the control chamber 1 present, the exhaust-gas recycling quantity would necessarily be falsified by the higher pressure gradient between the exhaust-gas and intake lines for a uniform opening of the exhaust-gas recycling valve. According to the invention, this is prevented by feeding the exhaust-gas counter-pressure upstream of the soot filter to the control chamber 2. For here a change of the exhaust-gas pressure caused by a change of throughflow resistance of the soot filter brings about a corresponding compensation of the opening position of the exhaust-gas recycling valve. Thus, for example, an increase of the exhaust-gas pressure triggers a corresponding pressure increase in the control chamber 2, with the result that, due to the interplay of the diaphragms 3, 4, the throughflow orifice of the exhaust-gas recycling valve is reduced by adjusting the closing part 6 of the exhaust-gas recycling valve.

The version described, with two chambers 1 and 2 subjected to pressure in different ways, also has the additional advantage that, when the chamber I is not activated, with an increasing exhaust-gas counterpressure the intended retaining force of the spring 5 increases in a desirable way in the closing direction of the closing part 6 of the exhaust-gas recycling valve.

Figure 2:
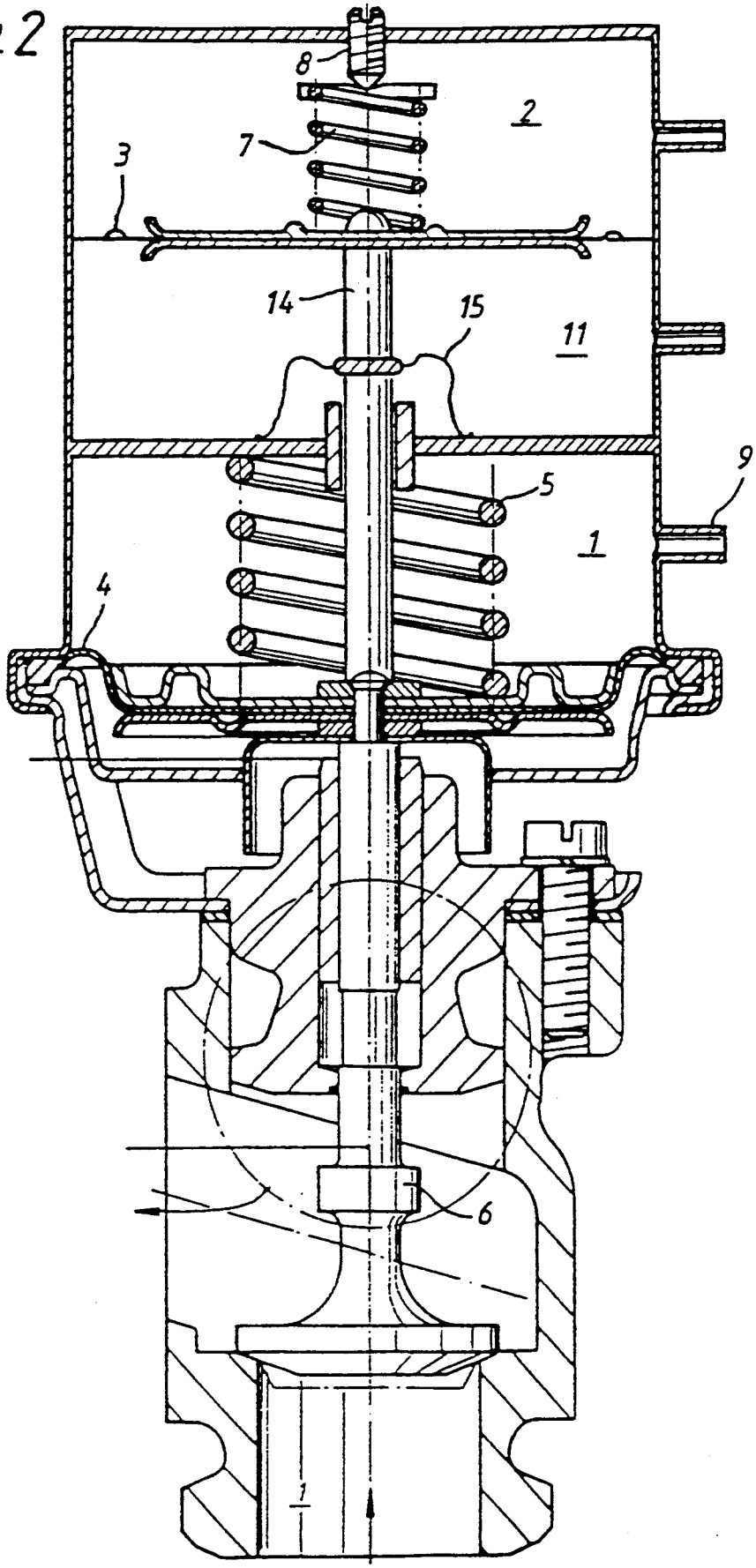
FIG. 2 is a schematic sectional view through an alternative embodiment of an exhaust-gas recycling valve, in which the disturbing resistances originating from the fresh-gas and exhaust-gas lines can be eliminated.

In the version of the pneumatic actuating drive of the exhaust-gas recycling valve according to FIG. 2, a disturbing influence originating from a change of flow resistance in the fresh-gas line can also be eliminated in addition by means of a third control chamber 11. Such a disturbing influence can originate, for example, from a changing throughflow resistance of the fresh-gas intake filter. For this purpose, the third chamber 11 is subjected to the particular pressure in the fresh-gas intake line via a connection piece 12. The third control chamber 11 is located between the first control chamber 1, from which it is separated by a rigid connecting wall 13, and the second control chamber 2, to which it is connected operatively via a first diaphragm 3. The closing part 6 of the exhaust-gas recycling valve is connected rigidly to the second diaphragm 4 of the first control chamber 1. Within the first control chamber 1, a first compression spring 5 is supported on the second diaphragm 4 on the one hand and on the rigid connecting wall 13 on the other hand. Guided displaceably through the connecting wall 13 is a driving rod 14 which is connected rigidly to the diaphragms 3 and 4.

Within the third control chamber Il, a diaphragm 15 surrounding the driving rod 14 is attached firmly to the driving rod 14 on the one hand and to the connecting wall 13 on the other hand. The effective surface of the diaphragm 15 within the third control chamber 11 is smaller than that of the first diaphragm 3. In general, the third control chamber 11, together with the diaphragms 3 and 15, is so designed that, when there is a reduction of the vacuum in the fresh-gas intake line, the closing part 6 of the exhaust-gas recycling valve is adjusted in the direction of a increase of the gas throughflow area of the exhaust-gas recycling valve. When there is an increase of the vacuum in the intake line, which can be caused by a contaminated intake-air filter, the closing part 6 acts in contrast in the direction of a reduction of the gas throughflow area of the exhaust-gas recycling valve. This is necessary in order to prevent an exhaust-gas recycling quantity which would otherwise increase undesirably as a result of the higher pressure gradient between the intake and exhaust-gas lines due to the control pressure remaining unchanged in the intake line because of the vacuum increase in the intake line controlled according to the family of characteristics and which should be dependent only on the engine characteristic data.

It is important for the functioning of the version of the exhaust-gas recycling valve according to FIG. 2 that the control pressure fed to the control chamber 1 be independent not only of the exhaust-gas pressure, but also of the fresh-gas pressure in the intake line.

With the designs according to the invention, it is not only possible to eliminate falsifications of the exhaust-gas recycling flow quantity caused by changes of flow resistance in the fresh-gas and/or exhaust-gas line, but furthermore it is thereby also possible to ensure that the exhaust-gas recycling flow can be increased or reduced according to a predetermined law in response to a change in pressure gradient between the fresh-gas line and exhaust-gas line.

With the control drive according to the invention for the exhaust-gas recycling valve, if a soot filter is present in the exhaust-gas line it is possible by a suitable coordination of the geometrical boundary conditions to set a dependence of the recycled exhaust-gas quantity on the exhaust-gas filter loading, characterized by the exhaust-gas counterpressure, which assists the regenerating capacity of the soot filter.

A further advantage of the exhaust-gas recycling valve actuating drive according to the invention is that, if a soot filter is subsequently installed in a diesel engine, a simple exchange of a conventional exhaust-gas recycling valve makes it possible to adapt the exhaust-gas recycling to the feed-pressure gradients between the exhaust-gas and fresh-gas lines which vary as a result of the soot filter.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. Device for controlling the exhaust-gas recycling quantity on an internal-combustion engine, with an exhaust-gas recycling line branched off from an exhaust-gas line to an inlet line and with an exhaust-gas recycling valve arranged in the exhaust-gas recycling line and comprising a valve controlling the connection between the inlet and outlet lines and a pneumatic control drive consisting of two diaphragms which are clamped in a housing and which are connected operatively to a closing part of the valve, at least one diaphragm being connected firmly to the closing part, and the two diaphragms each being loaded by a spring in the closing direction of the closing part, the diaphragms subdividing the housing into at least two control chambers, of which a first control chamber located between the diaphragms can be subjected to a control pressure determined as a function of the engine running and a second control chamber formed by the second diaphragm and the housing can be subjected to a further control pressure, wherein the second control chamber is subjected as a control pressure to the exhaust-gas pressure from the exhaust-gas line.

2. Device for controlling the exhaust-gas recycling quantity according to claim 1, wherein, interposed between the first and second control chambers, is a third control chamber which is separated from the first control chamber by a rigid connecting wall and on which the compression spring of the second diaphragm is supported, wherein the second diaphragm is attached rigidly to the first diaphragm via a driving rod guided displaceably through the connecting wall, wherein a third diaphragm sealing off the lead-in of the driving rod through the connecting wall is arranged in the third control chamber, and wherein the third control chamber is subjected to a control pressure from the inlet line.

* * * * *